United States Patent [19]

Tamura et al.

[11] Patent Number: 4,763,636

[45] Date of Patent: Aug. 16, 1988

[54] MECHANICAL SUPERCHARGER

[75] Inventors: Toru Tamura, Obu; Toshio Takeda, Nagoya; Shinji Kouno, Kariya, all of Japan

[73] Assignee: Aisin Seiki Kabushiki Kaisha, Kariya, Japan

[21] Appl. No.: 913,367

[22] Filed: Sep. 30, 1986

[30] Foreign Application Priority Data

Sep. 30, 1985 [JP] Japan ..... 60-149678

[51] Int. Cl.[4] ..... F02D 23/00

[52] U.S. Cl. ..... 123/564; 417/311

[58] Field of Search ..... 123/559, 564; 417/310, 417/311

[56] References Cited

U.S. PATENT DOCUMENTS

| | | | |
|---|---|---|---|
| 2,311,936 | 2/1943 | Elfes et al. | 123/564 |
| 4,243,010 | 1/1981 | Zopfi | 123/559 |
| 4,502,283 | 3/1985 | Wandel | 123/564 X |
| 4,611,568 | 9/1986 | Onaka et al. | 123/564 X |

*Primary Examiner*—Stephen F. Husar

*Attorney, Agent, or Firm*—Finnegan, Henderson, Farabow, Garrett and Dunner

[57] ABSTRACT

A mechanical supercharger utilized in internal combustion engines includes a housing having an inlet port, outlet port and a bypass passage disposed in the housing for connecting the inlet port and the outlet port with each other. A relief valve is disposed in the bypass passage for releasing an air pressure from the outlet port to the inlet port.

5 Claims, 4 Drawing Sheets

MECHANICAL SUPERCHARGER

BACKGROUND OF THE INVENTION

1. Field of the Invention

This invention relates a mechanical supercharger utilized in internal combustion engines, and more particularly to a mechanical supercharger wherein a relief valve is accommodated.

2. Description of the Related Art

It is well known that a relief control valve may be generally adopted to control supercharging pressure in a mechanical supercharger. In a conventional supercharger with a relief control valve, as shown in FIG. 1, a surge tank 22 is connected with an intake manifold 21 of an internal combustion engine 20. A relief valve 23 is disposed in the surge tank 22 so as to keep a suction air pressure in surge tank 22 under a predetermined value. The relief air from relief valve 23 is returned to an upstream portion of the supercharger 24 or to an air cleaner 27 via a control conduit 25 that is separate from the supercharger 24. Numeral 26 indicates a carburetor.

In the above-mentioned conventional relief control method, however, since the control conduit 25 is positioned outside of supercharger 24 and the construction of relief valve 23 is complicated, there is a drawback that the device has a large size. Furthermore, in the conventional mechanical supercharger, noises are generated by discharge pulsation of the supercharging pressure released from the relief valve. In addition, when the control conduit is disposed on the outside of the supercharger, there is a noise problem in that a radiating noise is released from the control conduit. When the mechanical supercharger 24' is located in the downstream portion of the carburetor 26 as shown in FIG. 1, there will be a further problem in that gasoline fuel can leak out from the joints of control conduit 25.

SUMMARY OF THE INVENTION

Accordingly, an object of the present invention is to eliminate the disadvantages of prior art mechanical superchargers.

More particularly, it is an object of the present invention to provide a mechanical supercharger wherein the generation of noises and the leakage of gasoline is substantially prevented.

Additional objects and advantages of the present invention will be set forth in part in the description that follows and in part will be obvious from the description or may be learned by practice of the invention. The objects and advantages of the invention may be realized and obtained by the apparatus particularly pointed out in the appended claims.

To achieve the objects and in accordance with the purpose of the invention, as embodied and as broadly described herein, a mechanical supercharger for compressing the precombustion intake mixture for an internal combustion engine comprises: a housing having an inlet port and an outlet port; compression means in the housing for compressing the precombustion intake mixture provided through the inlet port and discharging the compressed precombustion mixture through the outlet port; a bypass passage disposed in the housing for bypassing the compression means to directly connect the inlet port with the outlet port; and relief valve means disposed in the bypass passage for releasing outlet port pressure to the inlet port via said bypass passage.

Preferably, the insert member may have a relief valve means that comprises an insert member fixed in an elongated cavity in the housing, the insert member having an opening for communicating the bypass passage and inlet port with the outlet port, a slide valve slidably disposed in the insert member for opening and closing said insert member opening, and a spring for biasing the slide valve to close the insert member opening.

The insert member may have a chamber and an air relief hole through which the bypass passage and the chamber are connected. Alternatively, the insert member may be provided with a port member through which the chamber is selectively connected to one of a pressure source and a vacuum source to operate the relief valve.

In operation, when the supercharging pressure in the outlet rises beyond a predetermined value, the relief valve will be maintained in the open position. Air will then be returned to the inlet of the supercharger through the bypass passage, whereby the pressure in the outlet can be maintained at a constant value.

Other objects and their attendant advantages will become apparent as the following detailed description is read in conjunction with the accompanying drawings. The accompanying drawings, which are incorporated in and constitute a part of this specification, illustrate presently preferred embodiments of the invention and, together, with the description, serve to explain the principles of the invention.

DETAILED DESCRIPTION OF THE PREFERRED EMBODIMENT

Figure 1:
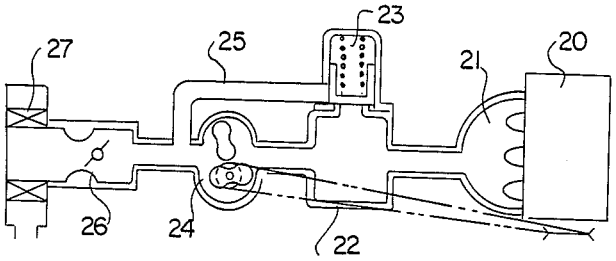
FIG. 1 PRIOR ART
FIG. 1 is a schematic view of an internal combustion engine with a conventional mechanical supercharger.

Reference will be made in detail to presently preferred embodiments of the invention, examples of which are illustrated in the accompanying drawings. Throughout the drawings, like reference characters are used to designate like elements.

Figure 2:
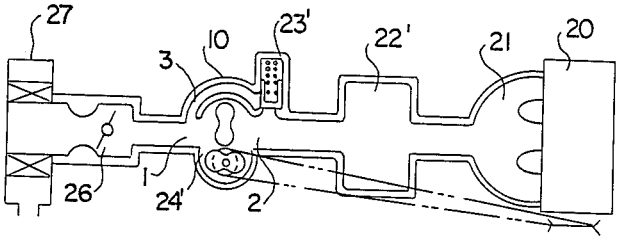
FIG. 2 is a schematic view of an internal combustion engine with the mechanical supercharger according to the present invention.

Referring to FIG. 2 of the drawings, there is shown an internal combustion engine 20 equipped with a mechanical supercharger 24' which is connected via a carburetor 26 to an air cleaner 27 and connected via a surge tank 22' to an intake manifold 21 of engine 20. Disposed in a housing 10 of supercharger 24' is a bypass passage 3 which connects an inlet 1 and an outlet 2 of supercharger 24' to each other through a relief valve 23' which is accommodated in bypass passage 3.

Figure 3:
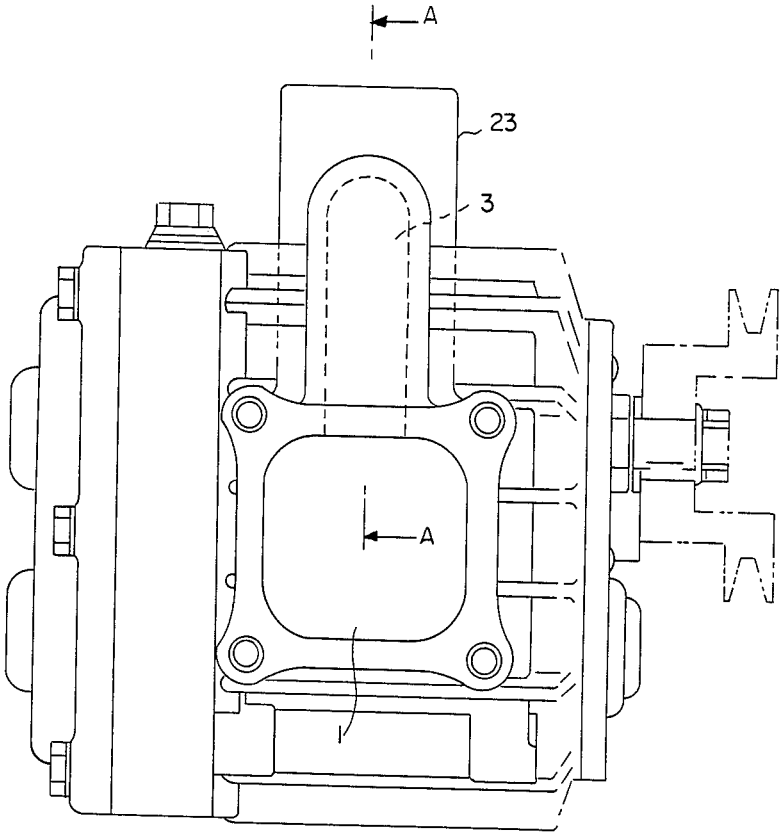
FIG. 3 is a side view of a mechanical supercharger constructed in accordance with one preferred embodiment of the present invention.
Figure 4:
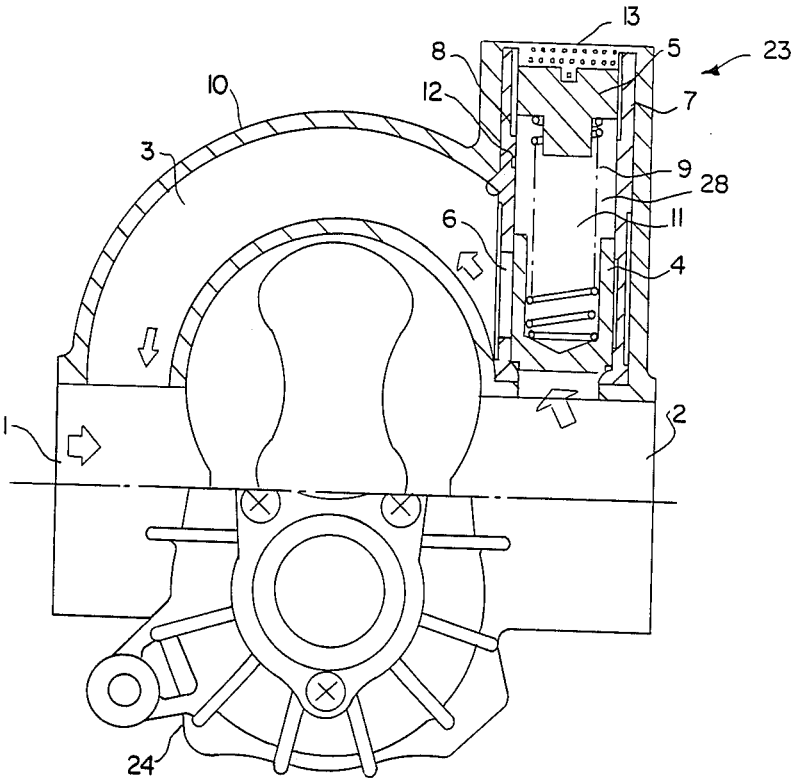
FIG. 4 is a sectional view taken along line A—A of FIG. 3.

Referring to FIGS. 3 and 4 which show the supercharger 24' in more detail, relief valve 23' is disposed in bypass passage 3 for controlling communication between inlet 1 and outlet 2. Relief valve 23' includes an insert member 7 disposed in an elongated cavity 28 formed in housing 10. A slide valve 4 is slidably disposed for controlling the opening and closing of a circular passage 6 formed in insert member 7. Passage 6 connects bypass passage 3 with the interior of relief valve 23' for communicating with outlet port 2. Slide valve 4 is constantly biased toward a bottom portion of insert member 7 by a spring 9 so as to close outlet port 2 from communicating with inlet port 1 through passages 6 and 3. Spring 9 is interposed between a projection portion of an adjusting screw 5 screwed in insert member 7 and an internal concave surface of slide valve 4. Formed in the insert member 7 is an air relief hole 12 which connects bypass passage 3 with a chamber 11 formed in the insert member 7 between slide valve 4 and adjusting screw 5. As the volume of chamber 11 decreases upon upward movement of slide valve 4, relief hole 12 prevents pressure within the chamber 11 from building up. An air pressure at which slide valve 4 is opened can be determined with accuracy only by a compression force of the spring 9. The degree of compression in spring 9 can be adjusted by adjusting screw 5 which is sealed by a sealing material 13 after the adjustment of spring 9.

In operation, when the supercharging pressure in outlet 2 of the supercharger 24' rises beyond a predetermined value, slide valve 4 will move upwardly and open circular passage 6 formed in insert member 7, thereby returning air (or the mixture of the air and fuel) in the outlet 2 to the inlet 1 of the supercharger 24' by means of passage 6 and bypass passage 3, thus maintaining the pressure in outlet 2 at a constant value.

Figure 5:
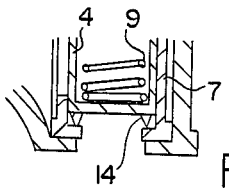
FIG. 5 is a fragmentary sectional view of a relief valve having a different construction from the relief valve in FIG. 3.

In another embodiment of the invention shown in FIG. 5, a rubber material 14 is fixedly secured to the bottom portion of slide valve 4 by means of adhesive or heating, whereby sealing performance of slide valve 4 can be improved and noise generation by slide valve 4 can be reduced.

Figure 6:
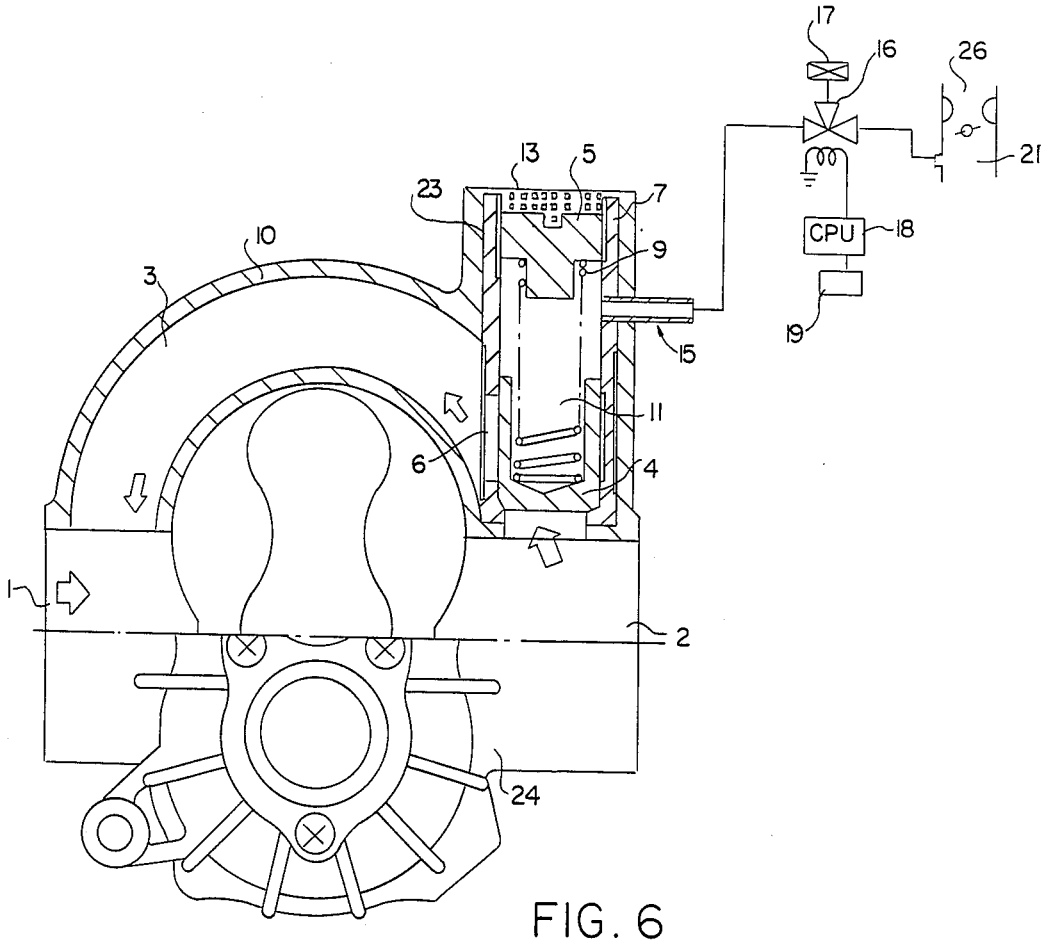
FIG. 6 is a sectional view similar to FIG. 4 taken along line A—A of FIG. 3, and showing another preferred embodiment of the invention.

FIG. 6 shows another embodiment of the present invention. In FIG. 6, a port member 15 is shown penetrating housing 10 and insert member 7. Chamber 11 is connected with an electromagnetic valve 16 through port member 15, for providing control over the operation of relief valve 23' in response to changes in engine drive conditions. Chamber 11 of the relief valve 23' is normally in communication with atmospheric pressure through air filter 17. With such an arrangement, if there is no need for the supercharging pressure such as during deceleration, during idling, and during high speed driving (more than 120 km/h), the electromagnetic valve 16 may be actuated by the action of a central processing unit 18 which processes electrical signals detected by sensors 19. When central processing unit 18 actuates valve 16, vacuum is supplied to chamber 11 of relief valve 23' from the intake manifold 21 of the engine, and hence slide valve 4 is operated to the open position thereby releasing the supercharging pressure.

As indicated heretofore, since the bypass passage is disposed in the housing of the supercharger, the bypass passage will be compact in size, and noises radiated from the bypass passage can be reduced in comparison with the conventional conduit passage shown in FIG. 1 which is separately positioned from the supercharger. Furthermore, because no conduit passage is connected with the housing of the supercharger, there are no joint portions from which gasoline can leak from the conduit passage.

It will be apparent to those skilled in the art that the supercharger of the present invention may be constructed in a variety of ways without, however, departing from the scope and spirit of the appended claims. The invention in its broader aspects is, therefore, not limited to the specific details, representative apparatus, and illustrative examples shown and described above. Thus, it is intended that all matter contained in the foregoing description and shown in the accompanying drawings shall be interpreted as illustrative and not in a limiting sense.

What is claimed is:

1. A mechanical supercharger for compressing the precombustion intake mixture for an internal combustion engine comprising:

a housing having an inlet port and an outlet port;

compression means in said housing for compressing the precombustion intake mixture provided through said inlet port and discharging the compressed precombustion mixture to said outlet port;

a bypass passage disposed in said housing for bypassing said compression means to directly connect said inlet port with said outlet port;

relief valve means disposed in said bypass passage for releasing outlet port pressure to said inlet port in response to a predetermined pressure differential between said inlet port and said outlet port;

said relief valve means comprising an insert member fixed in an elongated cavity in said housing, said insert member having an opening for communicating said bypass passage and inlet port with said output port, a slide valve slidably disposed in said insert member for opening and closing said insert member opening, and a spring for exerting a biasing force to said slide valve to close said insert member opening, said spring force being adjustable to selectively adjust said predetermined pressure differential; and a chamber formed in said insert member, said insert member having an air relief hole through which said bypass passage and said chamber are connected with each other.

2. The mechanical supercharger as defined in claim 1 wherein a rubber material is secured to a bottom portion of said slide valve by means of adhesive.

3. The mechanical supercharger as defined in claim 1 wherein a rubber material is secured to a bottom portion of said slide valve by means of heating.

4. A mechanical supercharger for compressing the precombustion intake mixture for an internal combustion engine comprising:

a housing having an inlet port and an outlet port;

compression means in said housing for compressing the precombustion intake mixture provided through said inlet port and discharging the compressed precombustion mixture to said outlet port;

a bypass passage disposed in said housing for bypassing said compression means to directly connect said inlet port with said outlet port;

relief valve means disposed in said bypass passage for releasing outlet port pressure to said inlet port in response to a predetermined pressure differential between said inlet port and said outlet port;

said relief valve means comprising an insert member fixed in an elongated cavity in said housing, said insert member having an opening for communicating said bypass passage and inlet port with said outlet port, a slide valve slidably disposed in said insert member for opening and closing said insert member opening, and a spring for exerting a biasing force to said slide valve to close said insert member opening, said spring force being adjustable to selectively adjsut said predetermined pressure differential;

a chamber formed in said insert member, said chamber communicating with a pressure source and a vacuum source through a port member; and an electromagnetic valve on said port member for selectively connecting said chamber with one of said pressure source and vacuum source to operate said relief valve means in response to driving conditions of said engine.

5. A mechanical supercharger as defined in claim 4 wherein said electromagnetic valve is actuated by a central processing unit which processes electrical signals supplied by sensors that detect driving conditions of said engine.

* * * * *